US005900089A

United States Patent [19]

Northam et al.

[11] Patent Number: 5,900,089

[45] Date of Patent: May 4, 1999

[54] PROCESS FOR MAKING CARBON-CARBON TURBOCHARGER HOUSING UNIT FOR INTERMITTENT COMBUSTION ENGINES

[75] Inventors: G. Burton Northam, Carrollton; Philip O. Ransone, Gloucester; H. Kevin Rivers, Hampton, all of Va.

[73] Assignee: The United States as represented by the Administrator of the National Aeronautics and Space Administration, Washington, D.C.

[21] Appl. No.: 08/963,291

[22] Filed: Nov. 3, 1997

Related U.S. Application Data

[62] Division of application No. 08/811,378, Mar. 4, 1997, Pat. No. 5,810,556

[60] Provisional application No. 60/012,940, Mar. 6, 1996.

[51] Int. Cl.[6] ..... F04D 29/44

[52] U.S. Cl. ..... 156/155; 156/245; 156/286; 264/29.1; 264/29.5; 415/200

[58] Field of Search ..... 156/155, 286, 156/285, 245, 242; 264/29.1, 29.5; 415/200

[56] References Cited

U.S. PATENT DOCUMENTS

| | | | |
|---|---|---|---|
| 4,683,809 | 8/1987 | Taylor | 92/208 |
| 4,736,676 | 4/1988 | Taylor | 92/212 |
| 4,909,133 | 3/1990 | Taylor et al. | 92/212 |
| 5,456,578 | 10/1995 | Honda et al. | 415/200 X |

*Primary Examiner*—Jeff H. Aftergut

*Attorney, Agent, or Firm*—Kurt G. Hammerle; George F. Helfrich

[57] ABSTRACT

An improved, lightweight, turbine housing unit for an intermittent combustion reciprocating internal combustion engine turbocharger is prepared from a lay-up or molding of carbon—carbon composite materials in a single-piece or two-piece process. When compared to conventional steel or cast iron, the use of carbon—carbon composite materials in a turbine housing unit reduces the overall weight of the engine and reduces the heat energy loss used in the turbocharging process. This reduction in heat energy loss and weight reduction provides for more efficient engine operation.

14 Claims, 2 Drawing Sheets

PROCESS FOR MAKING CARBON-CARBON TURBOCHARGER HOUSING UNIT FOR INTERMITTENT COMBUSTION ENGINES

CLAIM OF BENEFIT OF RELATED APPLICATION

This application is a division of application Ser. No. 08/811,378, filed Mar. 4, 1997, now U.S. Pat. No. 5,810,556, which claims, pursuant to 35 U.S.C. § 119, the benefit of priority from provisional application Ser. No. 60/012,940, with a filing date of Mar. 6, 1996 for this non-provisional application.

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

1. Field of the Invention

This invention relates to an improvement in a turbocharger for an intermittent combustion (IC) internal combustion engine and a process therefor, and more specifically to an improved turbine housing unit for said turbocharger which is fabricated from a lay-up or molding of carbon—carbon composite materials.

2. Description of the Related Art

Many intermittent combustion (IC) reciprocating engines are equipped with turbochargers, to improve engine efficiency. Typically, turbochargers consist of three principal components: a turbine, a compressor, and a turbine housing unit. In operation, the turbine captures high-temperature gases coming from the engine exhaust manifold. These exhaust gases then are used to drive a compressor which, in turn, pumps high pressure air into the engine's inlet and compression chambers.

The effect of this process in a gasoline engine is to increase the volume of air available for combustion. Because more air is available, a correspondingly greater amount of fuel can be consumed, or burned, per cycle. In theory, the greater the fuel burned, the greater the horsepower. For diesel engines, the expansion of the high-temperature exhaust gases through the turbine connected to the compressor leads to more efficient operation because the inlet air charge is also increased leading to a higher compression ratio in the compression chambers. As these high-temperature exhaust gases would otherwise be expelled from the engine through an exhaust system, capturing and using the kinetic and thermal energy from the exhaust gases increases overall engine efficiency and horsepower. In an expansion cycle, the exhaust gas turbine can also be coupled to the engine drive train to increase cycle efficiency.

Internal combustion reciprocating engines used for aerospace, military, and transportation applications must be lightweight and capable of operating at elevated temperatures and pressures. Under the current state-of-the-art, turbocharger turbine housing units and gas exhaust manifolds for gasoline and diesel engines are made of steel, cast iron, Ni-resistant iron, or ductile iron with ceramic liners. Turbocharger turbine housing units fabricated from steel or iron are relatively heavy. Excessive weight is detrimental to engine efficiency and prohibitive in aerospace applications. Hence, a lightweight alternative to steel or iron turbine housing units would be a highly desired improvement in the prior art.

Likewise, steel and iron inherently possess excessive thermal conductivity which increases heat energy loss. As the captured gas heat energy dissipates, less energy is available to drive the turbocharger turbine, thereby reducing the performance and efficiency of the turbine. In addition, in compound diesel engines, the heat energy loss of the high-temperature exhaust gases reduces cycle efficiency. Consequently, a less thermally conductive substitute for steel or iron would be a highly-desired improvement in the prior art.

While Ni-resistant iron is lighter than steel or cast iron, it is very expensive. Likewise, ductile iron is lighter than steel or cast iron, yet it remains relatively heavy overall. A further disadvantage of ductile iron turbocharger turbine housing units is disclosed in U.S. Pat. No. 5,456,578 (Honda et al.). According to Honda et al., "|w|hen ductile iron material is used for a turbine housing ||, the surface of the ductile housing is oxidized and deteriorated by the heat of the high-temperature exhaust gas." In some instances such deterioration exerts "an especially great influence on |engine| efficiency" either because the clearance between the turbine rotors and the turbine housing unit allows the high-temperature gases to escape, or because the turbine housing unit itself is "insufficiently sealed." Therefore, a lightweight alternative to steel and iron turbine housing units which is neither oxidized nor deteriorated by the heat of the high-temperature engine exhaust gases would be a highly-desired improvement in the prior art.

ORIGIN OF THE INVENTION

Accordingly, an object of this invention is to reduce the weight of an IC internal combustion reciprocating engine.

It is another object of the present invention to minimize the loss of engine exhaust gas heat energy, to improve the engine cycle efficiency.

It is still another object of the present invention to coat the surface or near surface of a turbine housing unit and/or the surface or near surface of any exhaust gas ducting with a sealant, to provide protection from oxidation.

It is a further object of the present invention to provide a process for fabricating a turbine housing unit and exhaust-gas duct-work.

According to the present invention, the foregoing and additional objects are attained by fabricating a turbocharger turbine housing unit and exhaust gas duct-work for an internal combustion engine from a lay-up or molding of carbon—carbon composite materials.

Carbon—carbon composite materials were developed for high temperature and high strength aerospace applications. Carbon—carbon composites are inherently lightweight; maintain their strength at elevated temperatures (i.e. up to 2500 degrees Fahrenheit); and can be manufactured with low coefficients of thermal expansion, low specific heat, and tailorable thermal conductivity.

Carbon—carbon composite materials, as used herein, refer to a predominantly carbon matrix material reinforced with predominantly carbon fibers, and are well known to the art. The properties of these materials may be tailored to produce the desired mechanical and physical properties by preferred orientation of the continuous or staple fibers in the composite; and/or by the selection of additives or metric precursors; and/or by thermal treatment of the fibers and matrix before, during, or after fabrication. Carbon—carbon composite materials may be cast, molded, or laid up, and are machineable. The surface or near-surface of carbon—carbon composite materials also can be treated and/or coated with a sealant or coating, to protect against oxidation.

The use of low thermal inertia carbon—carbon composite materials for turbocharger turbine housing units and exhaust duct piping, i.e. the duct-work between the engine exhaust valves and the turbocharger as well as the duct-work between the turbocharger and the engine intake valves, in IC internal combustion reciprocating engines reduces engine weight and reduces exhaust gas heat. It is also possible to improve the response time of the turbocharger. Consequently, use of carbon—carbon composite materials in fabricating IC internal combustion reciprocating engines significantly improves engine cycle efficiency and potentially produces a more responsive turbocharger by minimizing heat energy loss.

By coating the surface or near-surface of the turbine housing unit, which is subject to the high-temperature engine exhaust gases, protection from oxidation and deterioration is detected. Metallic coatings of silicon, or ceramic coatings of silicon carbide or silicon nitride effectively protect carbon—carbon composite materials from oxidation.

DETAILED DESCRIPTION OF THE INVENTION

Figure 1A:
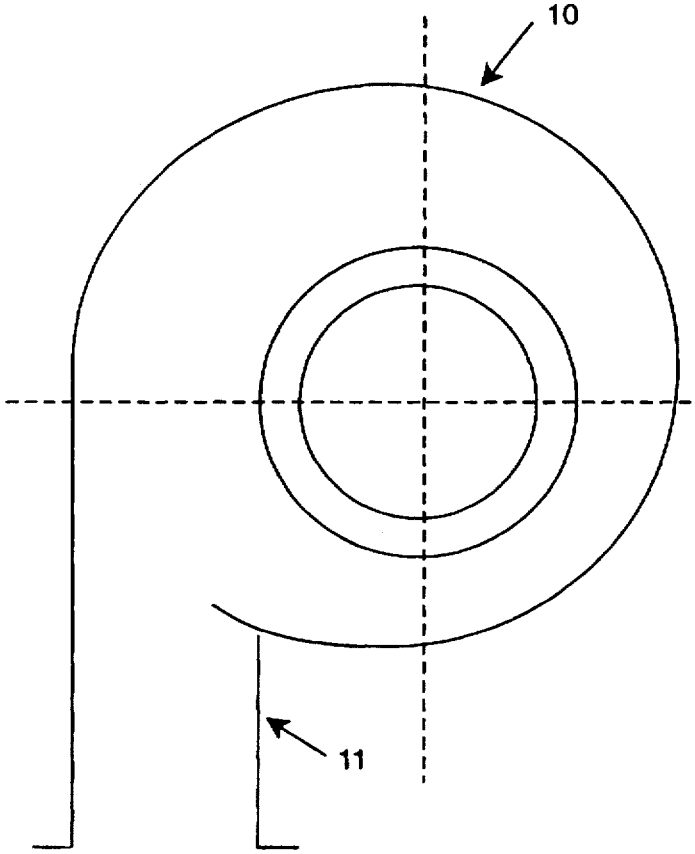
FIG. 1a PRIOR ART
FIGS. 1A and 1B are the illustration of a turbocharger of the prior art which are fabricated from steel or cast-iron.
Figure 1B:
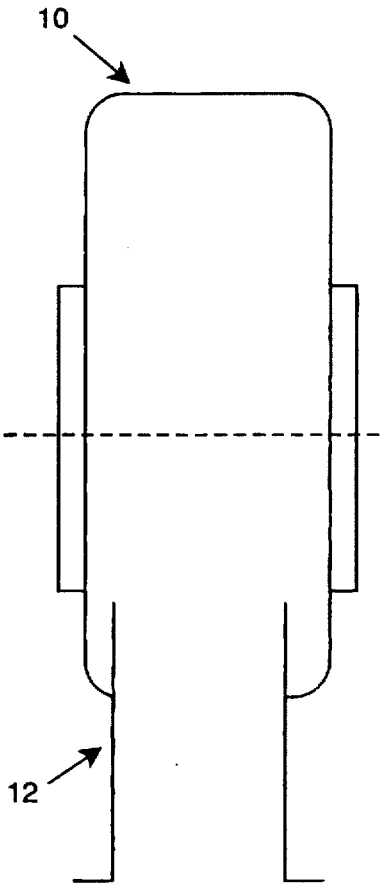
FIG. 1b PRIOR ART

A typical steel or cast-iron turbocharger turbine housing unit 10 for a gasoline or diesel engine of the prior art is depicted in FIG. 1 in both plan 11 and side 12 views. Typically, the turbine housing unit 10 consists of a single piece which is either cast or molded. The turbine housing unit 10 is internally contoured to provide the required gas flow vector to the turbine compressor and to reduce pressure losses which decrease efficiency.

Figures 2A, 2B:
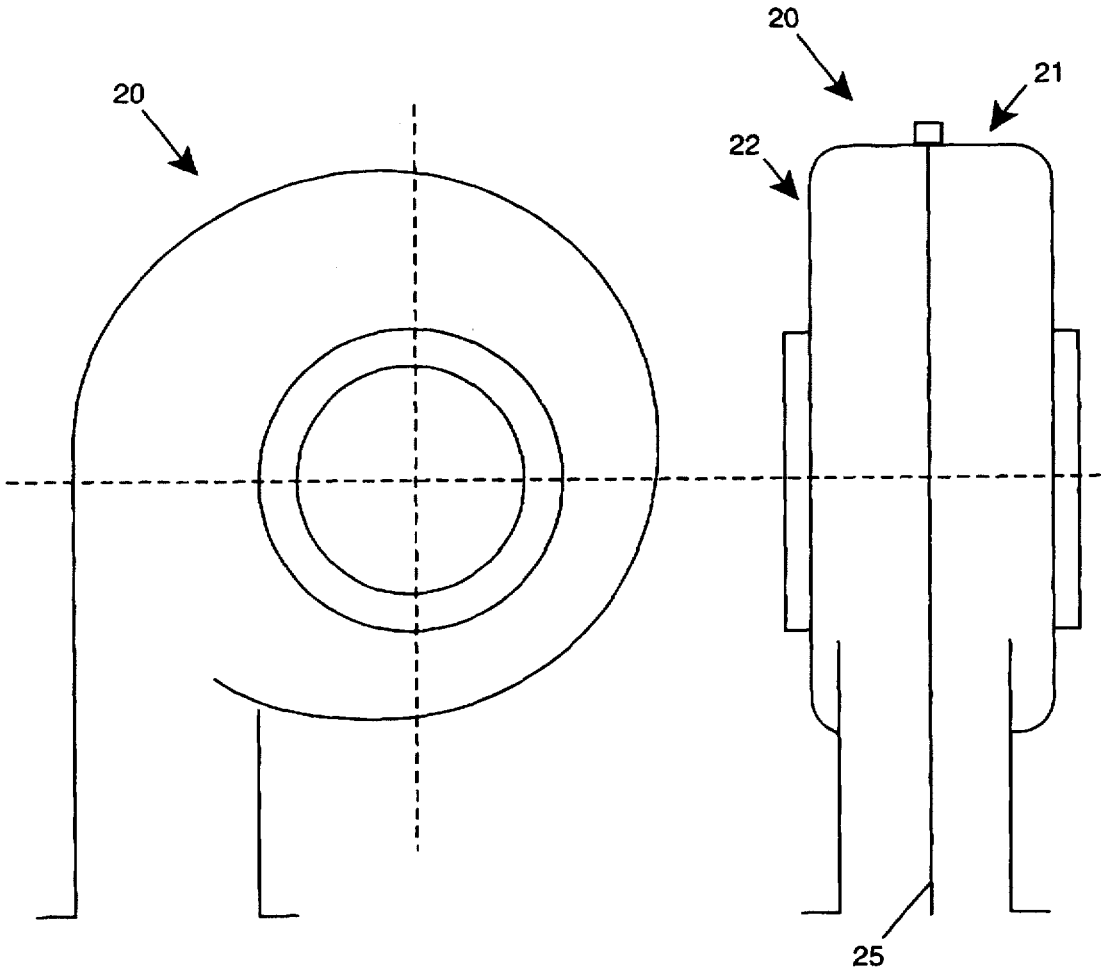
FIGS. 2A and 2B are the illustration of a turbocharger according to the present invention which are fabricated from carbon—carbon composite materials

In contrast, FIG. 2 depicts a turbocharger turbine housing unit 20 fabricated from carbon—carbon composite materials according to the present invention. Turbine housing unit 20 consists either of a single-or a two-piece configuration. The single-piece configuration differs from the prior art only in the materials used and by the process of manufacture. The two-piece configuration, however, is new to the art and involves joining a right turbine housing unit half 21 to a left turbine housing unit half 22 at a parting line 25. The turbine housing unit halves 21, 22 are clamped, banded, or bonded to form an integral unit.

One embodied method of manufacture according to the present invention consists of laying up carbon—carbon composite materials about an internal mandrel. Internal mandrels are designed to provide any desired aerodynamic shape to the inside of the turbine housing unit and are known to the art. Internal mandrels should be fabricated from materials which retain their shape during the lay-up or molding process, but which also can be burned out or washed out once the turbine housing unit has been formed. For this purpose, internal mandrels of wood sand, and/or Styrofoam® are suitable.

The lay-up process is performed manually, to produce a single-piece or a two-piece turbine housing unit. The manual lay-up process involves stacking prepregged carbon fabric layers over an internal mandrel to form a laminated turbine housing unit preform; heating the laminated preform to fuse the fabric layers together and to cure the carbonaceous matrix resin; pyrolizing the laminated preform to drive off hydrocarbons and to burn-out the internal mandrel; and re-impregnating the preform with a carbonaceous resin system as necessary to achieve the desired density. The density is also improved by vapor deposition.

To protect against oxidation, the inside surfaces of turbine housing unit are sealed or coated with a ceramic, such as silicon carbide or silicon nitride, or a metallic material. During the initial step of stacking the prepregged carbon fabric layers over the internal mandrel, the molded preform is most effective when the fabric layers are densifed as they are laid-upon during this initial step as with a vacuum bag. As an alternate to a vacuum bag for a two-piece turbine housing unit, a rubber plug may be used to densify the prepregged carbon fabric layers. After the prepregged carbon fabric layers are stacked over the internal mandrel, a rubber plug is placed over the fabric layers and a steel or cast iron plate is secured to the internal mandrel so as to confine the prepregged carbon fabric layers and the rubber plug therebetween. When this preform is heated to cure the matrix resin, the rubber plug expands and compresses the prepregged carbon fabric layers together, i.e. densifies the prepregged carbon fabric layers.

A more economical, and a more preferred embodiment of the present process of manufacture consists of a two-piece turbine housing unit which is fabricated by molding carbon—carbon composite materials. The two-piece molding process is preferred over manual laying-up as it eliminates time-consuming manual fabrication and because additional re-densification is not necessary. In the molding process, the steps of manufacture include molding carbon—carbon about an internal mandrel to form a laminated turbine housing unit preform; heating the laminated preform to fuse the fabric layers together and to cure the carbonaceous matrix resin; and pyrolizing the laminated preform to drive off hydrocarbons. To protect against oxidation, the inside and/or outside surfaces of turbine housing unit are sealed or coated with a ceramic, such as silicon carbide or silicon nitride, or a material, such as silicon.

The invention can be practiced in other manners than are described herein without departing from the spirit and the scope of the appended claims.

What is claimed is:

1. A method of fabricating a single-piece carbon—carbon composite turbine housing unit for an internal combustion engine turbocharger, which comprises:

(a) stacking prepregged carbon fabric layers over an internal mandrel to form a turbine housing unit preform;

(b) densifying the prepregged carbon fabric layers;

(c) heating the turbine housing unit preform to cure resins in the prepregged carbon fabric layers;

(d) pyrolizing the turbine housing unit preform to remove hydrocarbons in the prepregged carbon fabric layers and to burn out the internal mandrel; and (e) re-impregnating the turbine housing unit preform with additional resins, to densify said turbine housing preform.

2. A method of fabricating a single-piece carbon—carbon composite turbine housing unit for an internal combustion engine turbocharger as in claim 1, wherein densifying the prepregged carbon fabric layers includes the step of employing a vacuum bag to press the carbon fabric layers together.

3. A method of fabricating a single-piece carbon—carbon composite turbine housing unit for an internal combustion engine turbocharger as in claim 1, wherein densifying the prepregged carbon fabric layers includes the sequential steps of:

(a) placing a rubber plug against the prepregged carbon fabric layers; and (b) securing the rubber plug against the prepregged carbon fabric layers so that when heated the rubber plug will expand against the prepregged carbon fabric layers, to densify the prepregged carbon fabric layers.

4. A method of making a single-piece carbon—carbon composite turbine housing unit for an internal combustion engine turbocharger, which comprises:

(a) molding prepregged carbon fabric layers to form a turbine housing unit preform;

(b) densifying the prepregged carbon fabric layers;

(c) heating the turbine housing unit preform to cure resins in the prepregged carbon fabric layers;

(d) pyrolizing the turbine housing unit preform to remove hydrocarbons in the prepregged carbon fabric layers; and (e) re-impregnating the turbine housing unit preform with additional resins to densify the turbine housing preform.

5. A method of making a single-piece carbon—carbon composite turbine housing unit for an internal combustion engine turbocharger as in claim 4, wherein densifying the prepregged carbon fabric layers includes the step of employing a vacuum bag to press the carbon fabric layers together.

6. A method of making a single-piece carbon—carbon composite turbine housing unit for an internal combustion engine turbocharger as in claim 4, wherein densifying the prepregged carbon fabric layers includes the sequential steps of:

(a) placing a rubber plug against the prepregged carbon fabric layers; and (b) securing the rubber plug against the prepregged carbon fabric layers so that when heated the rubber plug will expand against the prepregged carbon fabric layers, to densify the prepregged carbon fabric layers.

7. A method of fabricating a two-piece carbon—carbon composite turbine housing unit for an internal combustion engine turbocharger, which comprises:

(a) stacking prepregged carbon fabric layers over an internal mandrel to form a left and a right turbine housing unit preform;

(b) densifying the prepregged carbon fabric layers in the left and right turbine housing unit preforms;

(c) heating the left and right turbine housing unit preforms to cure resins in the prepregged carbon fabric layers;

(d) pyrolizing the left and right turbine housing unit preforms to remove hydrocarbons in the prepregged carbon fabric layers;

(e) re-impregnating the left and the right turbine housing unit preforms with additional resins to densify the left and right turbine housing preforms; and (f) connecting the left turbine housing preform with the right turbine housing preform.

8. A method of fabricating a two-piece carbon—carbon composite turbine housing unit for an internal combustion engine turbocharger as in claim 7, wherein connecting the left turbine housing preform with the right turbine housing preform is effected by banding, bonding, or clamping the left turbine housing preform to the right turbine housing preform.

9. A method of fabricating a two-piece carbon—carbon composite turbine housing unit for an internal combustion engine turbocharger as in claim 7, wherein densifying the prepregged carbon fabric layers includes the step of employing a vacuum bag to press the carbon fabric layers together.

10. A method of fabricating a two-piece carbon—carbon composite turbine housing unit for an internal combustion engine turbocharger as in claim 7, wherein densifying the prepregged carbon fabric layers includes the sequential steps of:

(a) placing a rubber plug against the prepregged carbon fabric layers; and (b) securing the rubber plug against the prepregged carbon fabric layers so that when heated the rubber plug will expand against the prepregged carbon fabric layers, to densify the prepregged carbon fabric layers.

11. A method of making a two-piece carbon—carbon composite turbine housing unit for an internal combustion engine turbocharger, which comprises:

(a) molding prepregged carbon fabric layers to form a left and a right turbine housing unit preform;

(b) densifying the prepregged carbon fabric layers on the left and right turbine housing unit preforms;

(c) heating the left and right turbine housing unit preforms to cure resins in the prepregged carbon fabric layers;

(d) pyrolizing the left and right turbine housing unit preforms to remove hydrocarbons in the prepregged carbon fabric layers;

(e) re-impregnating the left and the right turbine housing unit preforms with additional resins to densify the left and right turbine housing preforms; and (f) connecting the left turbine housing preform with the right turbine housing preform.

12. A method of making a two-piece carbon—carbon composite turbine housing unit for an internal combustion engine turbocharger as in claim 11, wherein densifying the prepregged carbon fabric layers includes the step of employing a vacuum bag to press the carbon fabric layers together.

13. A method of making a two-piece carbon—carbon composite turbine housing unit for an internal combustion engine turbocharger as in claim 11, wherein densifying the prepregged carbon fabric layers includes the sequential steps of:

(a) placing a rubber plug against the prepregged carbon fabric layers; and (b) securing the rubber plug against the prepregged carbon fabric layers so that when heated the rubber plug will expand against the prepregged carbon fabric layers, to densify the prepregged carbon fabric layers.

14. A method of making a two-piece carbon—carbon composite turbine housing unit for an internal combustion engine turbocharger as in claim 11, wherein connecting the left turbine housing preform with the right turbine housing preform is effected by banding, bonding, or clamping the left turbine housing perform to the right turbine housing preform.

* * * * *